US005911831A

United States Patent [19]

Behringer

[11] Patent Number: 5,911,831

[45] Date of Patent: Jun. 15, 1999

[54] DEVICE FOR A CONTACT-FREE APPLICATION OF A LIQUID MATERIAL

[75] Inventor: Roland Behringer, Augsburg, Germany

[73] Assignee: MAN Roland Druckmaschinen AG, Offenbach am Main, Germany

[21] Appl. No.: 09/046,107

[22] Filed: Mar. 23, 1998

[30] Foreign Application Priority Data

Mar. 21, 1997 [DE] Germany ..... 19711984

[51] Int. Cl.[6] ..... B05C 11/00

[52] U.S. Cl. ..... 118/673; 101/228

[58] Field of Search ..... 101/228; 242/554, 242/556; 156/357, 502, 505, 578; 118/673, 712

[56] References Cited

U.S. PATENT DOCUMENTS

| | | | |
|---|---|---|---|
| 4,848,632 | 7/1989 | Mack et al. | 101/228 X |
| 5,152,472 | 10/1992 | Spang et al. | 242/58.3 |
| 5,614,059 | 3/1997 | Boriani et al. | 242/556 X |

FOREIGN PATENT DOCUMENTS

| | | | |
|---|---|---|---|
| 0 486 812 A2 | 5/1992 | European Pat. Off. | B65H 45/30 |
| 0 656 311 A2 | 6/1995 | European Pat. Off. | B65H 45/30 |
| 4033470 C1 | 4/1992 | Germany . | |
| 96/26148 | 8/1996 | WIPO | B65H 45/30 |

*Primary Examiner*—Edgar Burr
*Assistant Examiner*—Minh H. Chau
*Attorney, Agent, or Firm*—Cohen, Pontani, Lieberman & Pavane

[57] ABSTRACT

A device for contact-free application of a liquid material to a substrate includes an application head with a nozzle for applying the liquid to the substrate. A web edge sensor determines the position of a longitudinal edge of the printing web and transmits an output signal representing that position to the application head via a control device or an adjusting device on an operating console. The adjusting device and control device provide manual or automatic adjustment of the position of the nozzle relative to the current position of the longitudinal edge.

5 Claims, 2 Drawing Sheets

DEVICE FOR A CONTACT-FREE APPLICATION OF A LIQUID MATERIAL

BACKGROUND OF THE INVENTION

1. Field of the Invention

The invention relates to a device in a printing machine with an application head for applying glue in a line to a printing web.

2. Description of the Related Art

European reference EP 0 486 812 A2 discloses a device for applying a liquid to a substrate (printing web) in a printing machine. The application head described in that document applies a liquid, which is preferably glue, in the form of lines to a substrate, particularly to a paper web entering a folding device. It may happen, as the liquid is processed, that the liquid is not applied exactly along the desired line, but rather at a distance therefrom. This reference describes a device to check whether the liquid is applied exactly along the preestablished line or not; in the event of deviation, a defined repositioning of the application head is permitted.

In the known device, pigments are added to the application liquid, by means of which the liquid already applied to the substrate can be detected using special visualization means. As a result, the position of the lines of applied liquid can be measured. To readjust the application head applying this liquid, the applied liquid is made visible, the distance between the line formed by the applied liquid and the desired position is measured and, in the event of deviation, the associated application head is adjusted.

SUMMARY OF THE INVENTION

The object of the invention is to provide a device for applying a liquid to a substate and adjusting the position of an application head such that the application head is simply readjusted to the desired position, without adding pigments to the applied liquid.

This object is attained in a generic device which comprises a substrate edge sensing device and an alignment device for the application head which adjusts the position of the application head in response to an output of the edge sensing device.

The invention avoids contamination of the printing machine and the folding device. In addition, less spoilage is produced. The operation of the glue application device is made easier. In particular, the set-up time associated with the adjustment of the glue application device is reduced. When parameter changes occur in the folding device (for example, a fold adjustment), the glue track is repositioned automatically. A substantially line-shaped application of glue is achieved. Instead of glue, other liquids may be applied according to the invention, specifically, in a contact-free manner. By applying glue along the longitudinal edge of a first printing web, the latter can be connected to a second web.

It is especially advantageous for the application head to be automatically repositioned to its target position. The measures according to the invention result in a simpler and more economical structure of the device. Moreover, malfunctions of the application head are easily detected.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Examples of the invention are described below in greater detail in reference to the drawings. In the drawings.

DETAILED DESCRIPTION OF THE PRESENTLY PREFERRED EMBODIMENTS

Figure 1:
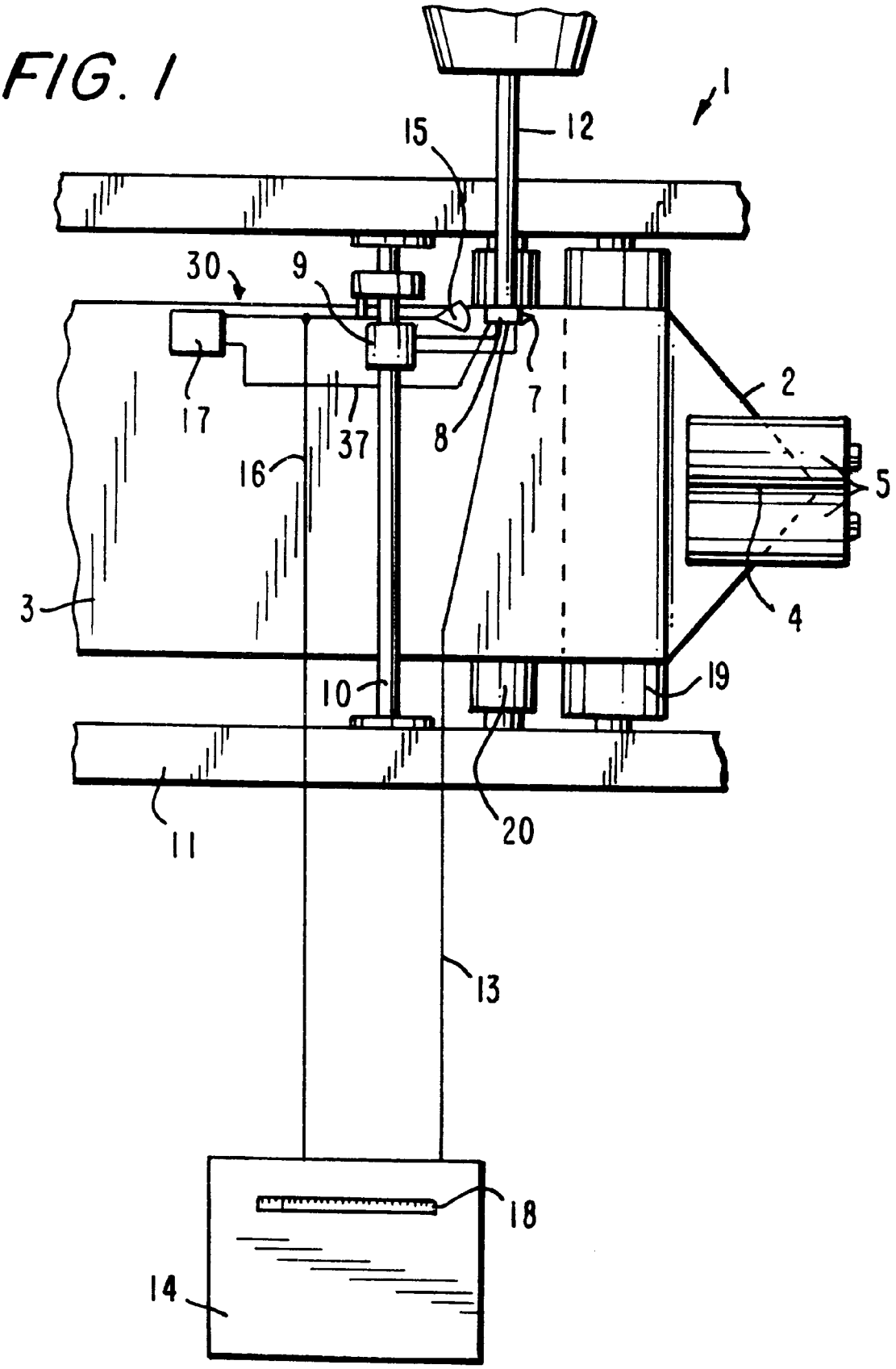
FIG. 1 is a top view of a longitudinal folding device with a device according to the invention for checking the position of and repositioning an application head for applying a liquid.

Referring to FIG. 1, a longitudinal folding device 1 includes a former 2 which is used for folding a printing web 3, such as, for example, a paper web, longitudinally along a line 4. During the folding process, the line 4 corresponds to the fold line produced by the gap between folding rollers 5. In some instances, to further process the printing web 3 in a knife folding unit that follows the longitudinal folding device (such as the knife folding unit 41 shown in FIG. 3 and described hereafter), it is necessary, for example, to connect the printing web 3 in the vicinity of its longitudinal edge to another printing web 6 running above the printing web 3 (See FIG. 2).

For gluing two printing webs, a hollow needle or a nozzle 7 is used to apply liquid glue to the printing web 3 in a contact-free manner. The nozzle 7 is connected to an application head 8, which is mounted by an associated holder 9 on a traverse 10 in the folding device 1. The traverse 10 is attached to the frame side walls 11 of the folding device 1 or to those of the printing machine upstream from the longitudinal folding device 1, so that the glue track is applied by the nozzle 7 either downstream of the former 2, for example, in front of a collection cylinder 33 (FIG. 3), or upstream of run-in rollers 19, 21 (FIG. 2) of the former 2. The application head 8 is equipped with switching elements for activating and deactivating the nozzle 7, to which liquid glue is supplied via a supply line 12. The switching elements of the application head 8 may be remotely controlled by a control line 13 from an operating console 14.

The position of the nozzle 7 is adjustable by suitable movement of the holder 9 along the traverse 10. A first web edge sensor 15 detects the position of a longitudinal edge 30 of web 3. The first web edge sensor 15 such as, for example, an optical, an acoustical, a pneumatic sensor, or any type of known sensor that reacts to fluctuations in the longitudinal edge 30 of the web 3 transmits a signal representing the position of the longitudinal edge 30 of the printing web 3 via a signal line 16 to the operating console 14. The position of the application head 8 may then be manually adjusted from the operating console 14 via the control line 13. Alternatively, the signal produced by the first web edge sensor 15 may be transmitted to a position controller 17, which readjusts the position of the application head 8 via a control line 37 relative to a target position that has initially been manually set from the operating console 14 via the control line 13. A reading scale 18 may optionally be arranged on the operating console 14 to display the position of the glue track on the printing web 3 relative to the longitudinal edge 30. The application head 8 for the glue is preferably arranged in the vicinity of the former 2, for example, upstream of the run-in roller 19 (FIG. 2) of the former 2. The application head 8 itself is located above a web guide roller 20.

In another embodiment, the operating console 14 is not required. Rather, whenever the course of the longitudinal edge 30 deviates from a set target value, the application head 8 is automatically readjusted by the control device 17.

Figure 2:
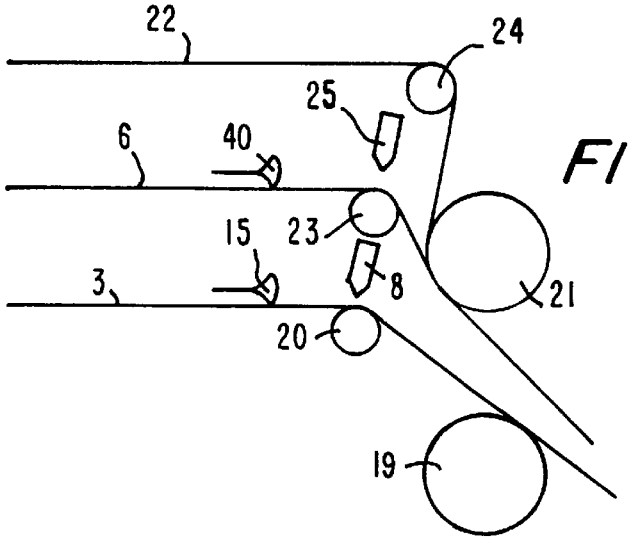
FIG. 2 is a lateral sectional view of the entry area for several printing webs to the longitudinal folding device.

Referring now also to FIG. 2, the former 2 longitudinally folds a plurality of printing webs 3, 6 and 22 running in between the former run-in roller 19 and the former run-in roller 21 along the longitudinal line 4. The printing webs 6 and 22 run via guide rollers 23 and 24. The application head 8 produces a glue track on the printing web 3 for connecting the printing webs 3 and 6. A further application head 25 produces a glue track on the printing web 6 for connecting printing web 22 on a lateral edge of printing web 6. The application head 25 is associated with a second web edge sensor 40, which is positioned relative to the application head 8 as shown in FIG. 1. Thus, according to the invention, a plurality of printing webs 3, 6, 22 may be accurately folded one atop the other and stuck together by glue at a preestablished distance from the longitudinal edge 30.

Figure 3:
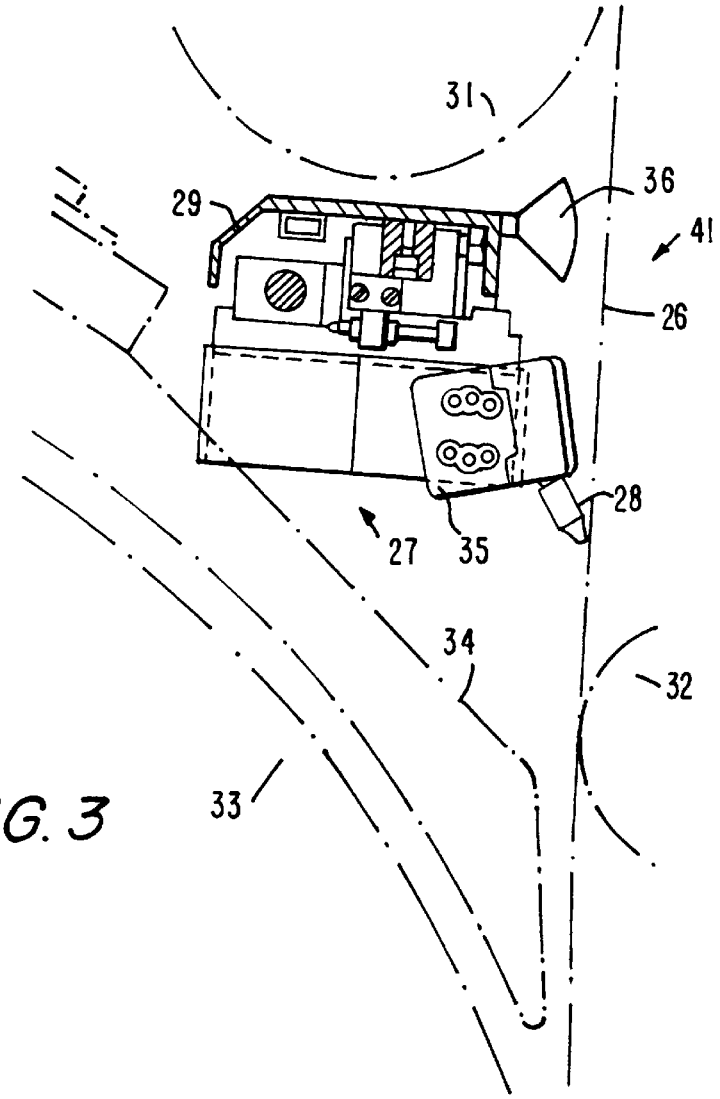
FIG. 3 is a lateral sectional view of an application head inside a knife folding unit of a printing machine.

Referring to FIG. 3, the invention may also be used in a knife folding unit 41 below, i.e., downstream of, the former 2. In this embodiment, a printing web 26 is provided with a glue track in the vicinity of its longitudinal edge (not shown in view of FIG. 3) by an application head 27 with a nozzle 28. The application head 27 is arranged on a traverse 29 so that it is movable substantially perpendicular to the direction of travel of the printing web 26. The application head 27 is arranged in an area between two guide rollers 31 and 32 and a collection cylinder 33. The collection cylinder 33 is protected against contamination by the glue by a cover 34. The nozzle 28 is preferably pivotally attached to the application head 27 by a pivotable holder 35. The position of the longitudinal edge of the web 26 is determined by a web edge sensor 36 and then converted via a control device (not shown here) into a signal for positioning the application head 27, so that the nozzle 28 provides the printing web 26 with a glue track at a preestablished distance from its longitudinal edge.

In general, the invention comprises an application head 25, 27 associated with a web edge sensor 15, 40, 36 for applying a liquid to a substrate, particularly a printing web 3, 6, 22, 26. The position of the longitudinal edge 30 of the printing web 3, 6, 22, 26, as determined by the web edge sensor 15, 40, 36, is transmitted to the application head 8, 27 via a control device 17 or an adjusting device in an operating console 14, so that the position of the nozzle 7, 28 for applying the liquid is adjusted manually or automatically relative to the current position of the longitudinal edge 30.

The invention is not limited by the embodiments described above which are presented as examples only but can be modified in various ways within the scope of protection defined by the appended patent claims.

I claim:

1. A device for applying glue in a substantially line-shaped application to a first printing web for connecting the first printing web to a second printing web in a printing machine, comprising:

an application head with a nozzle arranged for applying the glue along a target position relative to a longitudinal edge of the first printing web;

a web edge sensor for detecting a position of the longitudinal edge of the first printing web and generating an output signal representing the position of the longitudinal edge; and an aligning device for receiving the output signal and adjusting a position of the application head in response to the output signal.

2. The device of claim 1, further comprising a traverse portion arranged across a path of the first printing web wherein the application head is movably connected on the traverse and said aligning device comprises means for moving the application head along the traverse.

3. The device claim 2, wherein the aligning device comprises one of an automatic control device or a manual adjusting device.

4. The device of claim 1, further comprises an operating console including an adjusting device wherein the target position of the application head relative to the longitudinal edge of the first printing web is adjustable by the adjusting device on the operating console.

5. The device of claim 1, wherein the device is arrangeable upstream of a run-in roller of a longitudinal folding device in the printing machine or downstream of the run-in roller.

* * * * *

UNITED STATES PATENT AND TRADEMARK OFFICE

CERTIFICATE OF CORRRECTION

PATENT NO. : 5,911,831
DATED : June 15, 1999
INVENTOR(S) : Roland Behringer

It is certified that error appears in the above-identified patent and that said Letters Patent is hereby corrected as shown below:

TITLE PAGE, ADD THE FOLLOWING:

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 63 - | 1 | 2 | 2 | 6 | 7 | 3 | 08/09/88 | Japan | | | | |
| | | 63- | 1 | 0 | 6 | 6 | 4 | 6 | 07/09/88 | Japan | | | | |
| | | 1- | 1 | 2 | 0 | 9 | 7 | 4 | 08/16/89 | Japan | | | | |

OTHER REFERENCES (Including Author, Title, Date, Pertinent Pages, Etc.)

Japanese communication dated December 22, 1998 from JP 10-072799

Signed and Sealed this

Twenty-sixth Day of October, 1999

*Attest:*

Q. TODD DICKINSON

*Attesting Officer*

*Acting Commissioner of Patents and Trademarks*